US011538445B1

(12) United States Patent
Bailey, II

(10) Patent No.: US 11,538,445 B1
(45) Date of Patent: Dec. 27, 2022

(54) DETACHABLE NECK MECHANISM FOR SOLID OR HOLLOW BODY GUITAR

(71) Applicant: Robert Linn Bailey, II, Xiamen (CN)

(72) Inventor: Robert Linn Bailey, II, Xiamen (CN)

(73) Assignee: Journey Instruments Limited Hong Kong

( * ) Notice: Subject to any disclaimer, the term of this patent is extended or adjusted under 35 U.S.C. 154(b) by 0 days.

(21) Appl. No.: 17/476,089

(22) Filed: Sep. 15, 2021

(51) Int. Cl.
*G10D 3/00* (2020.01)
*G10D 3/095* (2020.01)
*G10D 1/08* (2006.01)

(52) U.S. Cl.
CPC ..... *G10D 3/095* (2020.02); *G10D 1/08* (2013.01)

(58) Field of Classification Search
CPC ..... G10D 3/095; G10D 1/08; G10D 3/00; G10D 1/00
See application file for complete search history.

(56) References Cited

U.S. PATENT DOCUMENTS 3,550,496 A 12/1970 Fender
4,073,211 A 2/1978 Jorgensen
4,793,236 A 12/1988 McGuire et al.
4,846,039 A 7/1989 Mosher
4,982,640 A 1/1991 Buscarino
5,125,311 A 6/1992 Boulanger et al.
5,305,819 A 4/1994 Boulanger et al.
5,337,644 A 8/1994 Fishman et al.
5,347,904 A 9/1994 Lawrence
5,353,672 A 10/1994 Stewart
5,949,005 A 9/1999 Peterson
6,028,255 A 2/2000 Myronyk
6,353,164 B1 3/2002 Corsi
6,911,590 B2 6/2005 Childress
7,081,575 B1 7/2006 Pieper, Jr. et al.
7,157,634 B1 1/2007 Babiez
7,375,267 B2 5/2008 Poschelk
7,442,865 B2 10/2008 Moghaddam
7,531,729 B1 5/2009 Davis et al.
7,557,281 B1 7/2009 Campling
(Continued)

FOREIGN PATENT DOCUMENTS

DE 102007026655 1/2008
DE 102007043792 3/2009
(Continued)

*Primary Examiner* — Kimberly R Lockett
(74) *Attorney, Agent, or Firm* — Quickpatents, LLC; Kevin Prince

(57) ABSTRACT

A stringed instrument has a stringed instrument neck that is removably attached to a stringed instrument body. A back plate is attached to a recess in a back side of the stringed instrument body. A latching mechanism can be mechanically affixed to the back plate. A latch pin retainer of the latching mechanism can include a slot formed therein. A latch pin can extend through the slot of the latch pin retainer, where the latch pin can be resiliently urged into a first position, with a lip of the latch pin operable to be secured against a latch pin catch disposed in the stringed instrument neck. A button is operable to move the latch pin into a second position with the lip disengaged from the latch pin catch, permitting separation of the stringed instrument neck from the stringed instrument body. A headstock can further be removably attached to the neck.

19 Claims, 17 Drawing Sheets

(56) References Cited

U.S. PATENT DOCUMENTS

| | | | | |
|---|---|---|---|---|
| 7,705,224 | B1 | 4/2010 | Ward | |
| 7,875,782 | B1 | 1/2011 | Nechviille | |
| 7,932,449 | B1 | 4/2011 | Minakuchi | |
| 3,183,446 | A1 | 5/2012 | Ward | |
| 8,952,230 | B2 | 2/2015 | Bailey, II | |
| 2003/0145712 | A1 | 8/2003 | Steinberger | |
| 2007/0107579 | A1 | 5/2007 | Babiez | |
| 2007/0163418 | A1 | 7/2007 | Allred | |
| 2011/0100191 | A1 | 5/2011 | Minakuchi | |
| 2014/0165816 | A1 | 6/2014 | Bailey, II | |
| 2018/0218717 | A1* | 8/2018 | Varona | A61J 1/2096 |

FOREIGN PATENT DOCUMENTS

| | | |
|---|---|---|
| DE | 102007043796 | 3/2009 |
| EP | 2137719 | 12/2009 |
| EP | 2323127 | 5/2011 |
| WO | 2009036828 | 3/2009 |
| WO | 2009036829 | 3/2009 |

* cited by examiner

DETACHABLE NECK MECHANISM FOR SOLID OR HOLLOW BODY GUITAR

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to stringed instruments, and more particularly to an attachment mechanism for allowing selective attachment and detachment of a stringed instrument from a stringed instrument body. Embodiments of the invention further relate to an attachment mechanism for attaching a stringed instrument headstock to a stringed instrument neck.

BACKGROUND

Mechanisms for allowing selective attachment and detachment of a stringed instrument neck from a stringed instrument body are known in the art. Such a stringed instrument may be a guitar, banjo, ukulele, or the like. However, such conventional mechanisms do not allow for consistent securing of the neck to the body, which results in inconsistent string tension and adversely affects the sound of the stringed instrument when played. Further, such conventional devices are relatively complicated and result in a conspicuous, unsightly appearance on the stringed instrument. Further, such conventional devices are difficult to utilize and may require tools, which is inconvenient particularly when traveling. Further, the conventional devices result in collapsed stringed instrument configurations that exceed standard checked baggage size limitations by commercial airlines.

For example, US Patent Application 2011/0100191, teaches a removable neck for a stringed instrument. However, a screwdriver is required to attach and detach such a removable neck. Further, with repeated use such screws can become loosened, affecting the string tension of the instrument adversely. Still further, the screws may damage the instrument if over-tightened and becoming stripped.

PCT Application PCT/EP2008/005655 has the additional drawback that reaching the screws from inside the body is difficult even with proper tools.

U.S. Pat. No. 7,442,865 teaches a guitar neck and strings assembly that is completely removable from a guitar body, but that is too long to take as anything but checked luggage on an airline.

German Patent 102007026655 teaches a removable stringed instrument neck that includes a stopping plate and a latch mechanism that is loosened or tightened manually without tools. However, such a latching mechanism essentially squeezes a neck portion against the body of the guitar in a manner that, if it becomes loose, affects the string tension and the sound of the guitar adversely.

U.S. Pat. No. 6,028,255 teaches a similar mechanism with similar drawbacks, except that when loosened only a small lip holds the neck onto the body of the instrument. Thus even a slight loosening of such a mechanism can result in the neck becoming completely disengaged from the body.

U.S. Pat. No. 7,375,267 teaches a detachable neck mechanism that does not require tools to detach and reattach. However, such a product does require significant space within the body of the guitar, which adversely affects the sound of acoustic instruments, such as an acoustic guitar or violin, for example.

Therefore, there is a need for a device that allows a stringed instrument neck to be selectively attached and detached from a stringed instrument body quickly and without tools. Such a needed mechanism would securely and consistently maintain the stringed instrument neck in proper position on the stringed instrument body, even if threaded fasteners thereof become slightly loosened such as during play. Such a needed device would provide a collapsed configuration that is within standard checked baggage size limitations by commercial airlines and would not adversely affect the sound of the instrument. The present invention accomplishes these objectives.

SUMMARY OF THE INVENTION

The present device is of a stringed instrument having a stringed instrument neck that is removably attached to a stringed instrument body. In some embodiments, the stringed instrument can include a guitar, as shown, or other stringed instruments, including, but not limited to a banjo, a ukulele, or the like. The stringed instrument can include a back plate attachable to a recess in a back side of the stringed instrument body. A latching mechanism can be mechanically affixed to the back plate. A latch pin retainer of the latching mechanism can include a slot formed therein. A latch pin can extend through the slot of the latch pin retainer, where the latch pin can be resiliently urged into a first position, with a lip of the latch pin operable to be secured against a latch pin catch disposed in the stringed instrument neck. A button is configured to be operable to move the latch pin into a second position with the lip disengaged from the latch pin catch, permitting separation of the stringed instrument neck from the stringed instrument body. A back plate extension can be attached to and can extend downward from the back plate, where the button is accessible through an opening through the back plate extension.

In some embodiments, the stringed instrument further includes a headstock removably attached to the stringed instrument neck. A ridge can be formed at an attachment end of the headstock, where the ridge can retain a nut of the headstock. Pins can extend from an attachment end of the headstock. The pins can fit into holes formed in the stringed instrument neck.

Embodiments of the present invention allow a stringed instrument neck to be selectively attached and detached from a stringed instrument body quickly and without tools. The innovative mechanism securely and consistently maintains the stringed instrument neck in proper position on the stringed instrument body when used to attach the stringed instrument neck to the stringed instrument body. Embodiments of the present invention are relatively simple and easy to use manually without tools. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
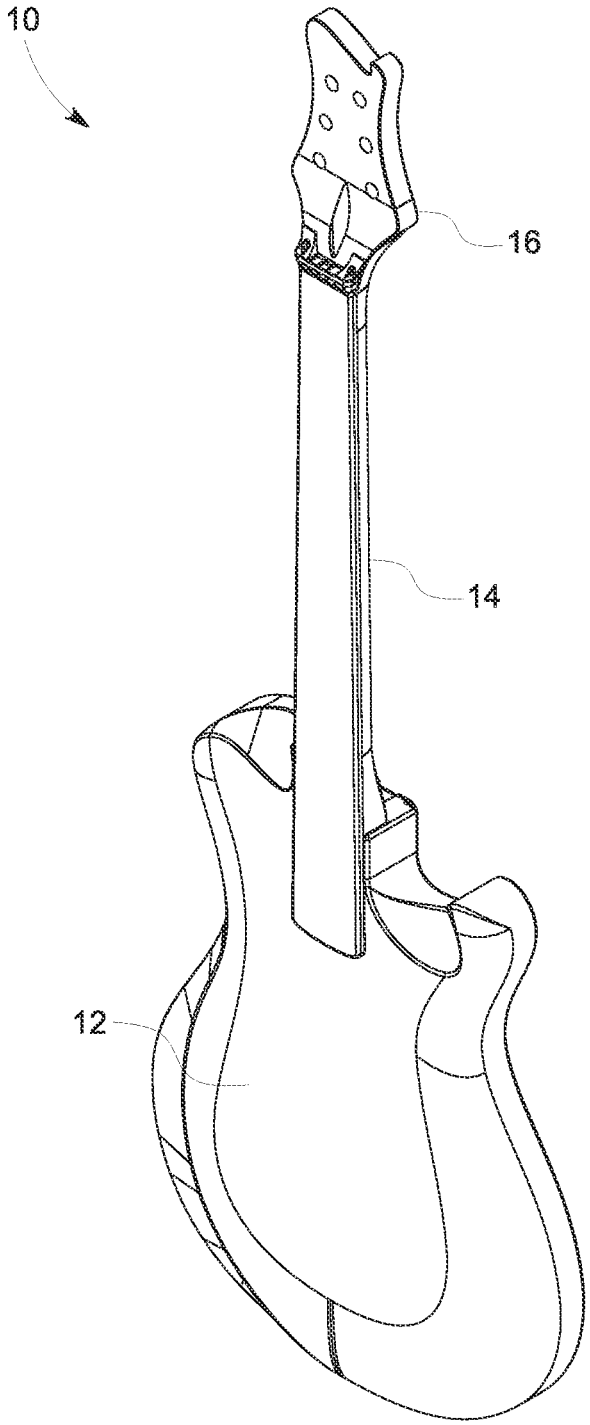
FIG. 1 is front perspective view of a stringed instrument according to an exemplary embodiment of the present invention.
Figure 2:
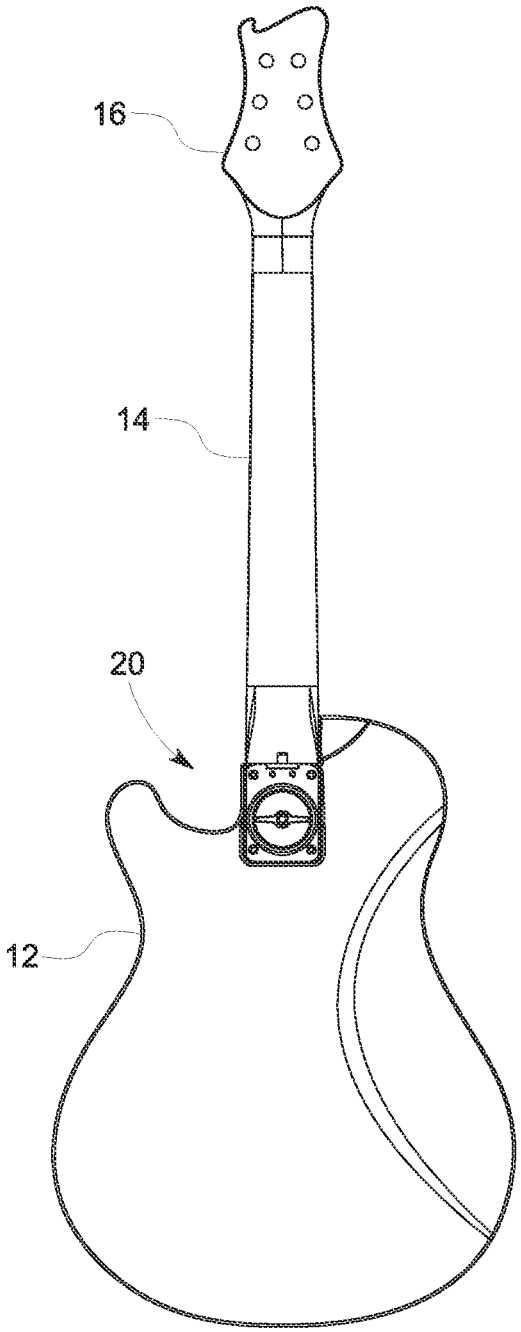
FIG. 2 is a back view of the stringed instrument of FIG. 1.
Figure 3:
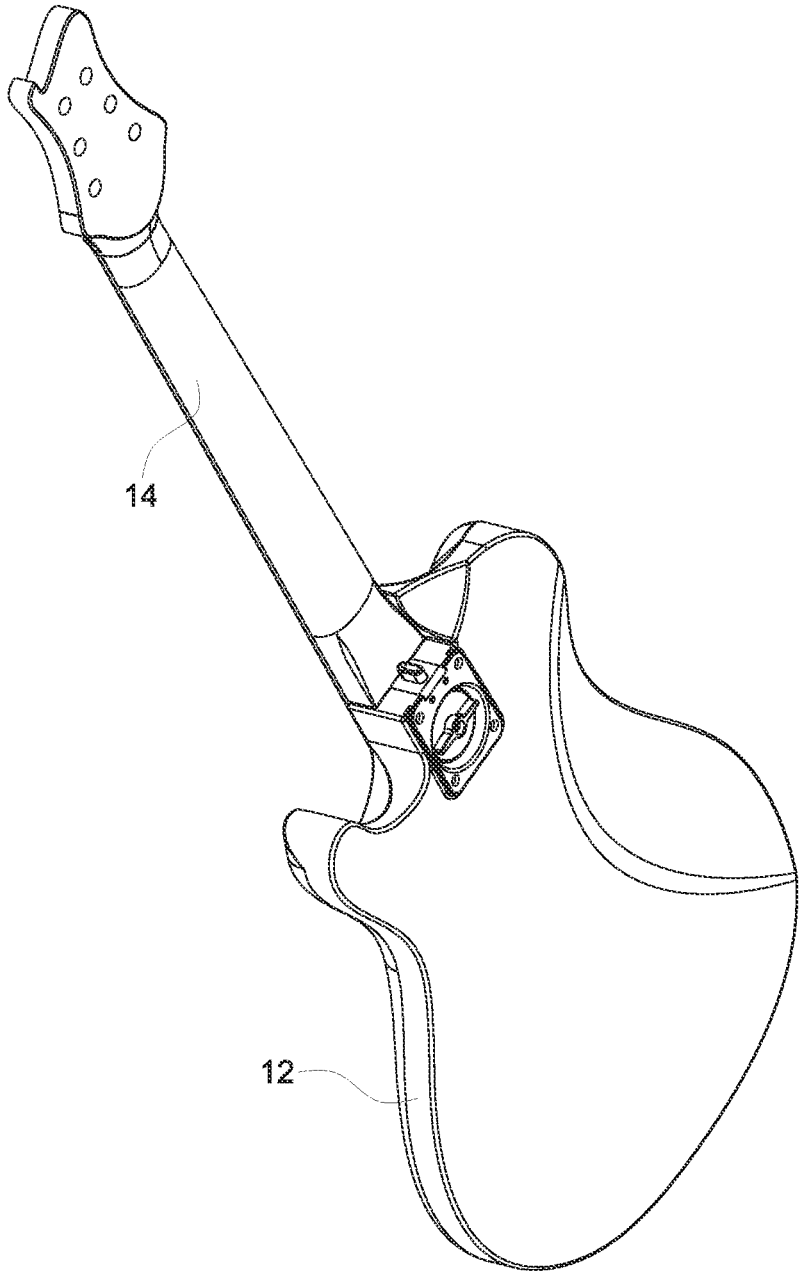
FIG. 3 is a back perspective view of the stringed instrument of FIG. 1.
Figure 4:
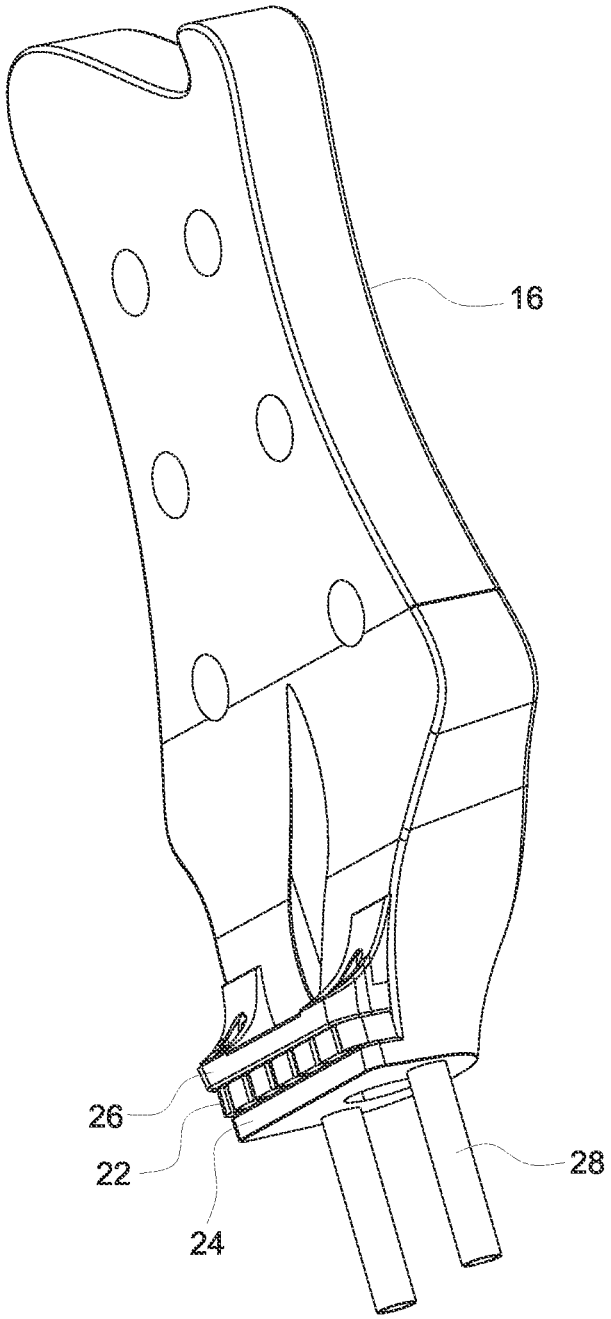
FIG. 4 is a perspective view of a headstock of the stringed instrument of FIG. 1.
Figure 5:
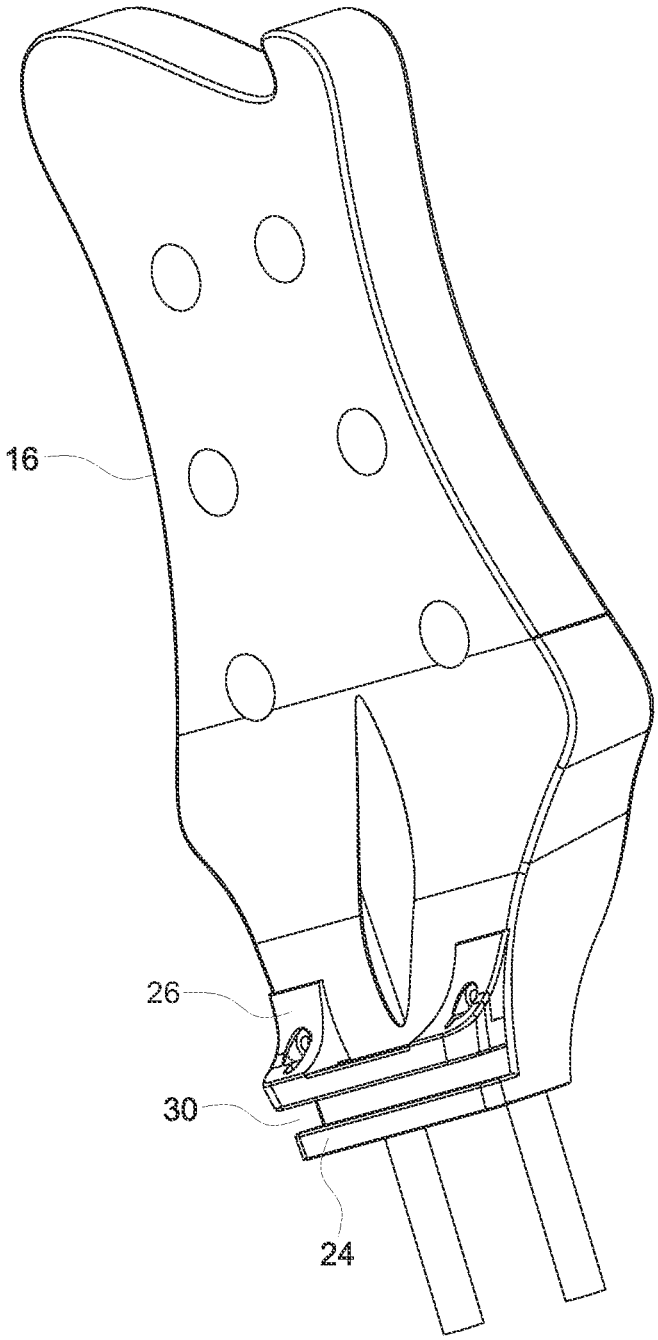
FIG. 5 is a perspective view of the headstock of FIG. 4 with the nut removed to reveal the nut positioning space.
Figure 6:
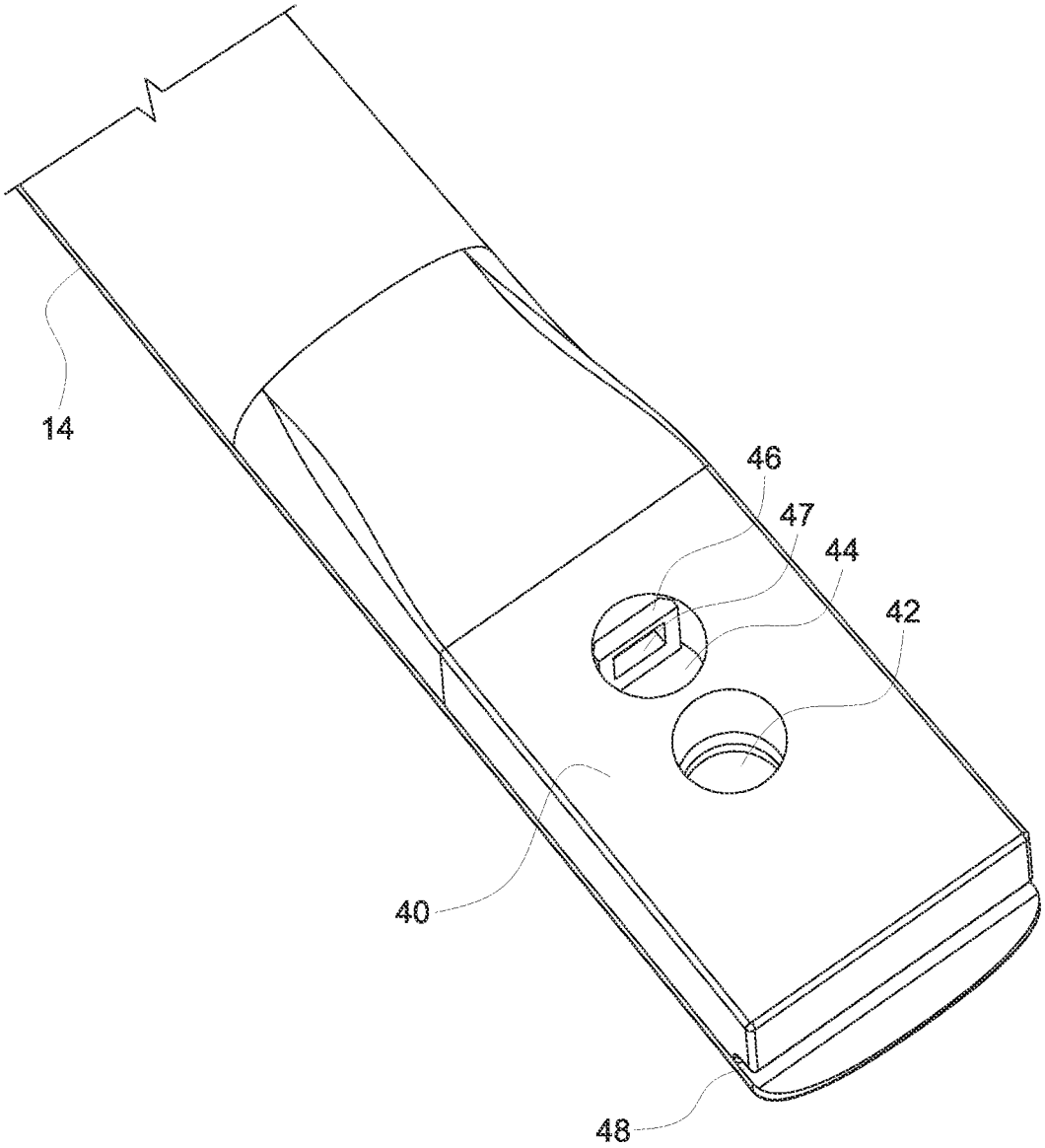
FIG. 6 is a detailed view of a connection end of a neck of the stringed instrument of FIG. 1.
Figure 7:
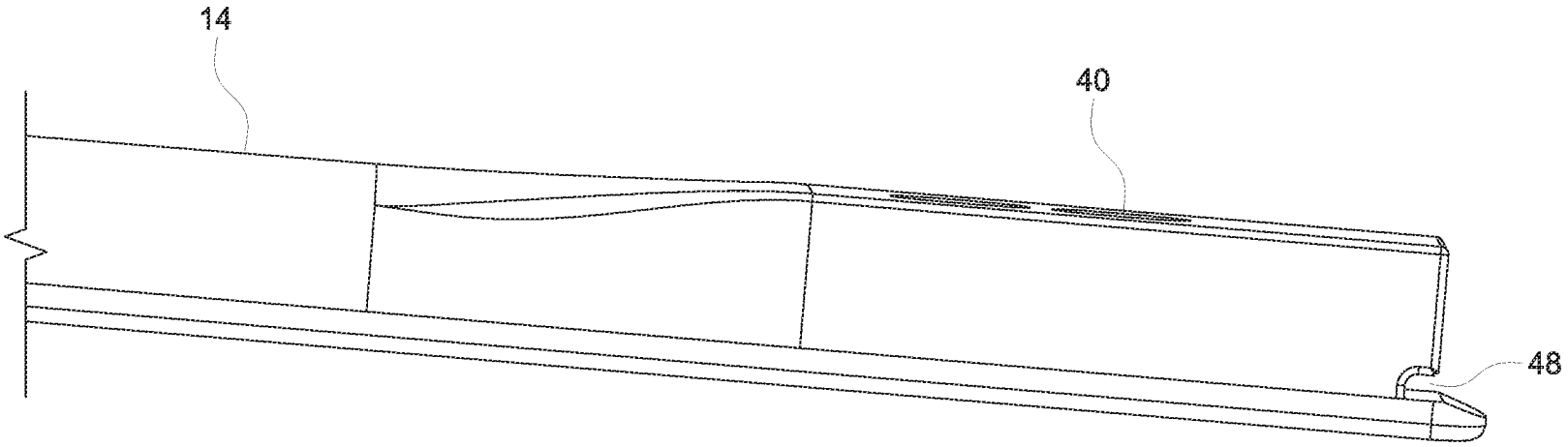
FIG. 7 is a detailed side view of the connection end of the neck of the stringed instrument of FIG. 1.
Figure 8:
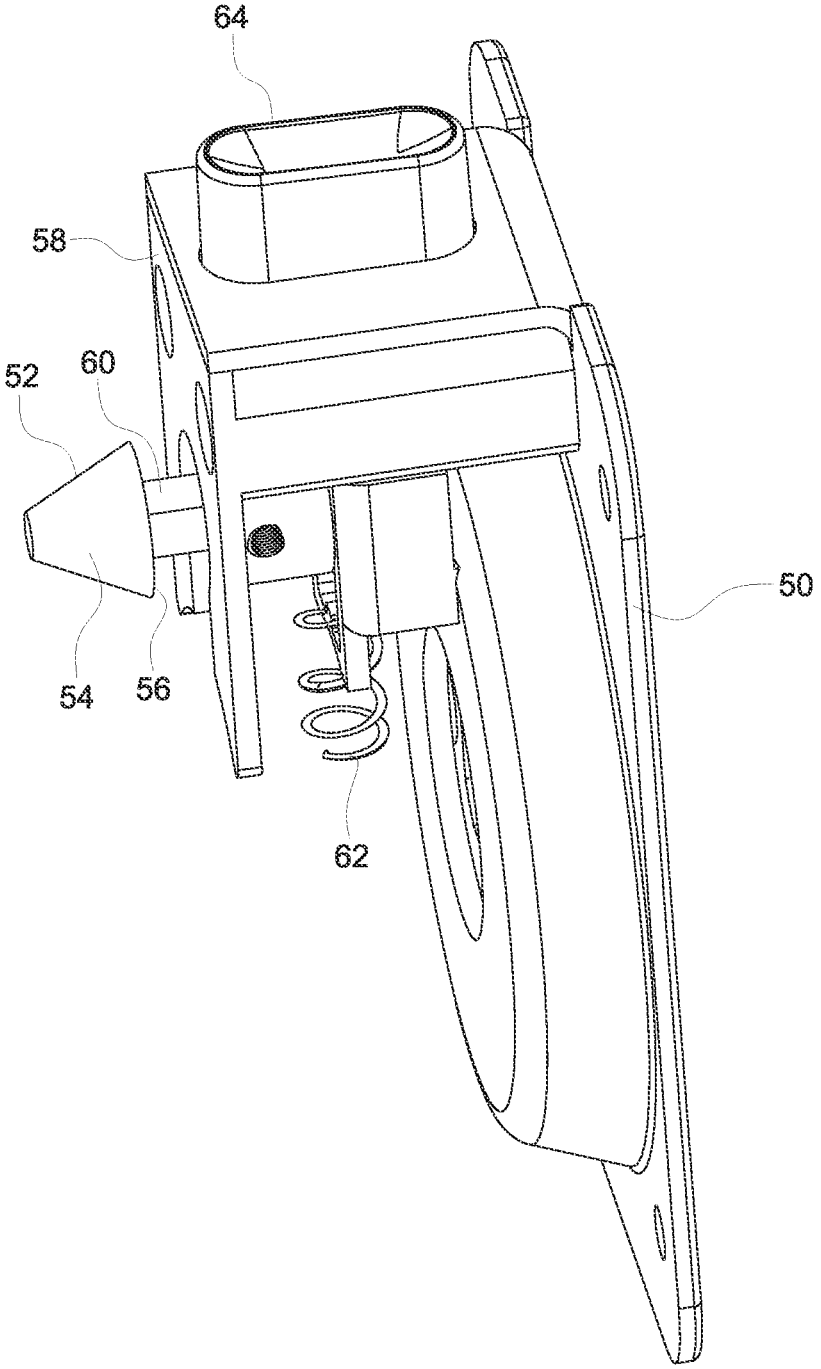
FIG. 8 is a rear perspective view of an exemplary latching assembly of the stringed instrument of FIG. 1.
Figure 9:
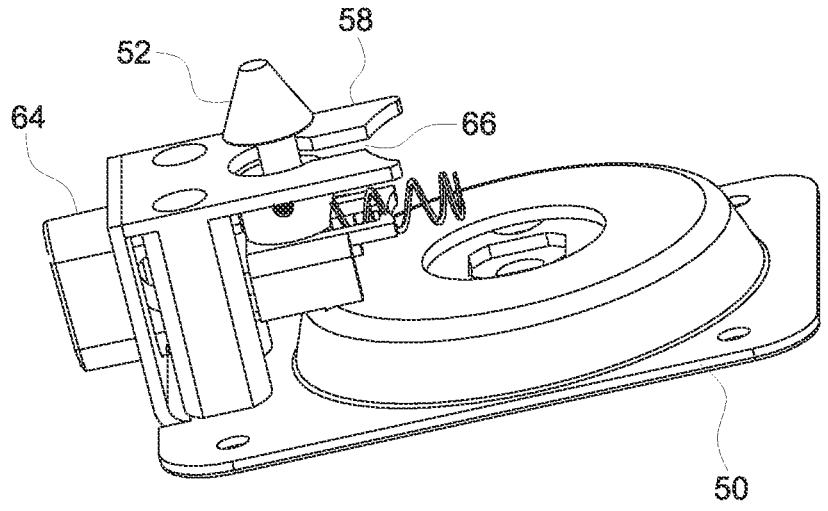
FIG. 9 is a top perspective view of the latching assembly of FIG. 8.
Figure 10:
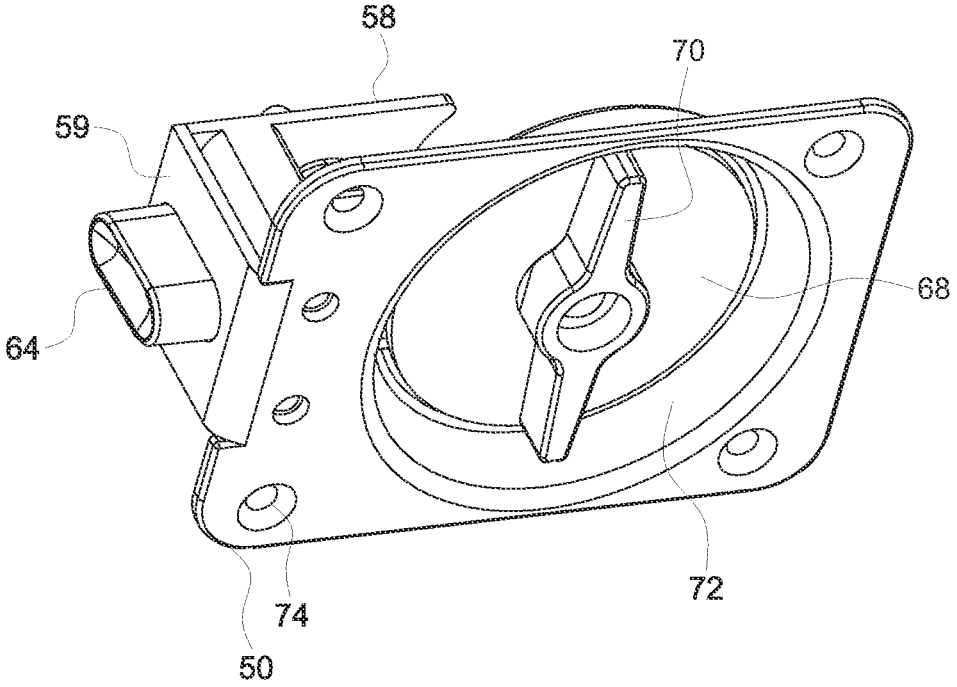
FIG. 10 is a bottom perspective view of the latching assembly of FIG. 8.
Figure 11:
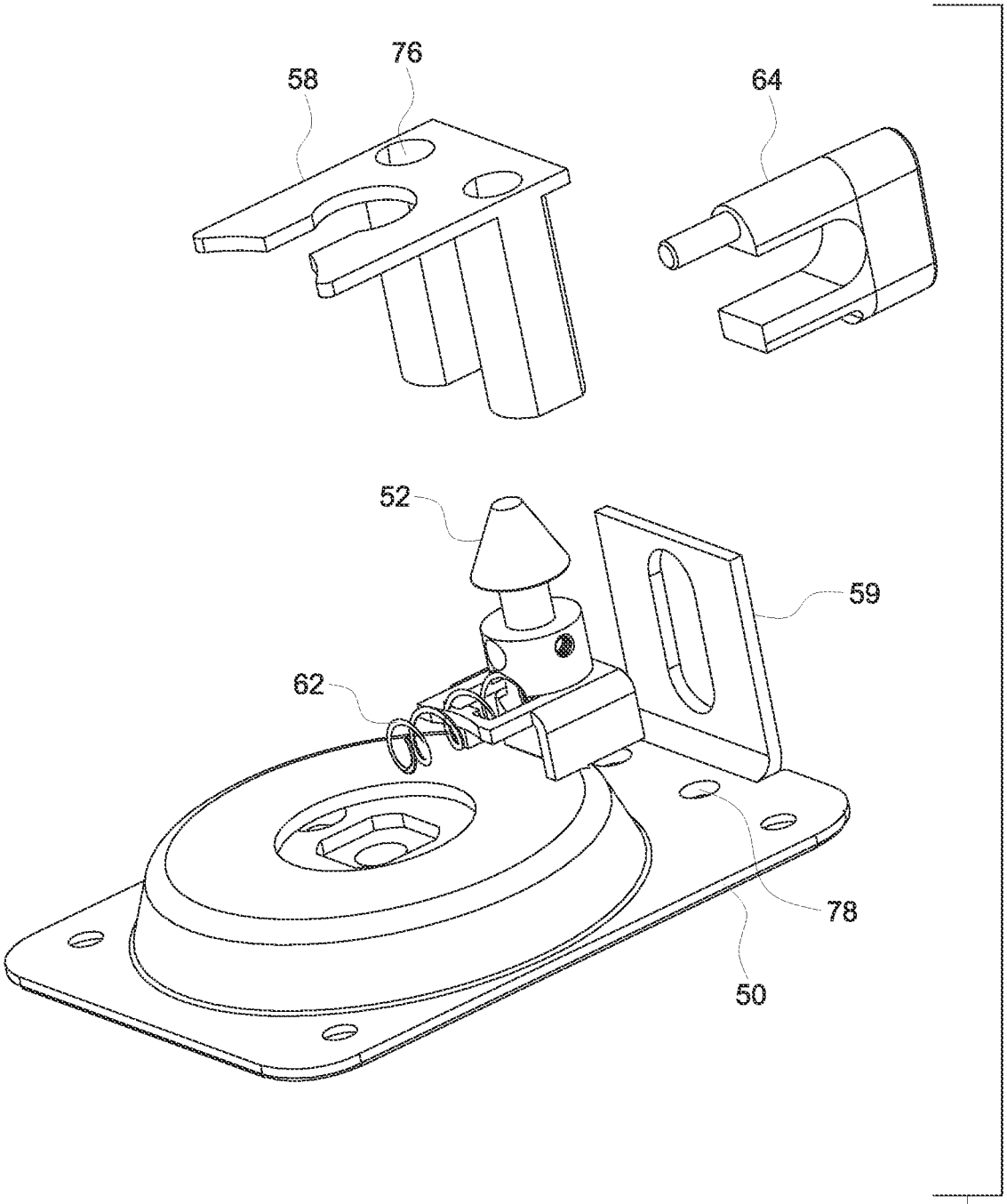
FIG. 11 is a partially exploded top perspective view of the latching assembly of FIG. 8.
Figure 12:
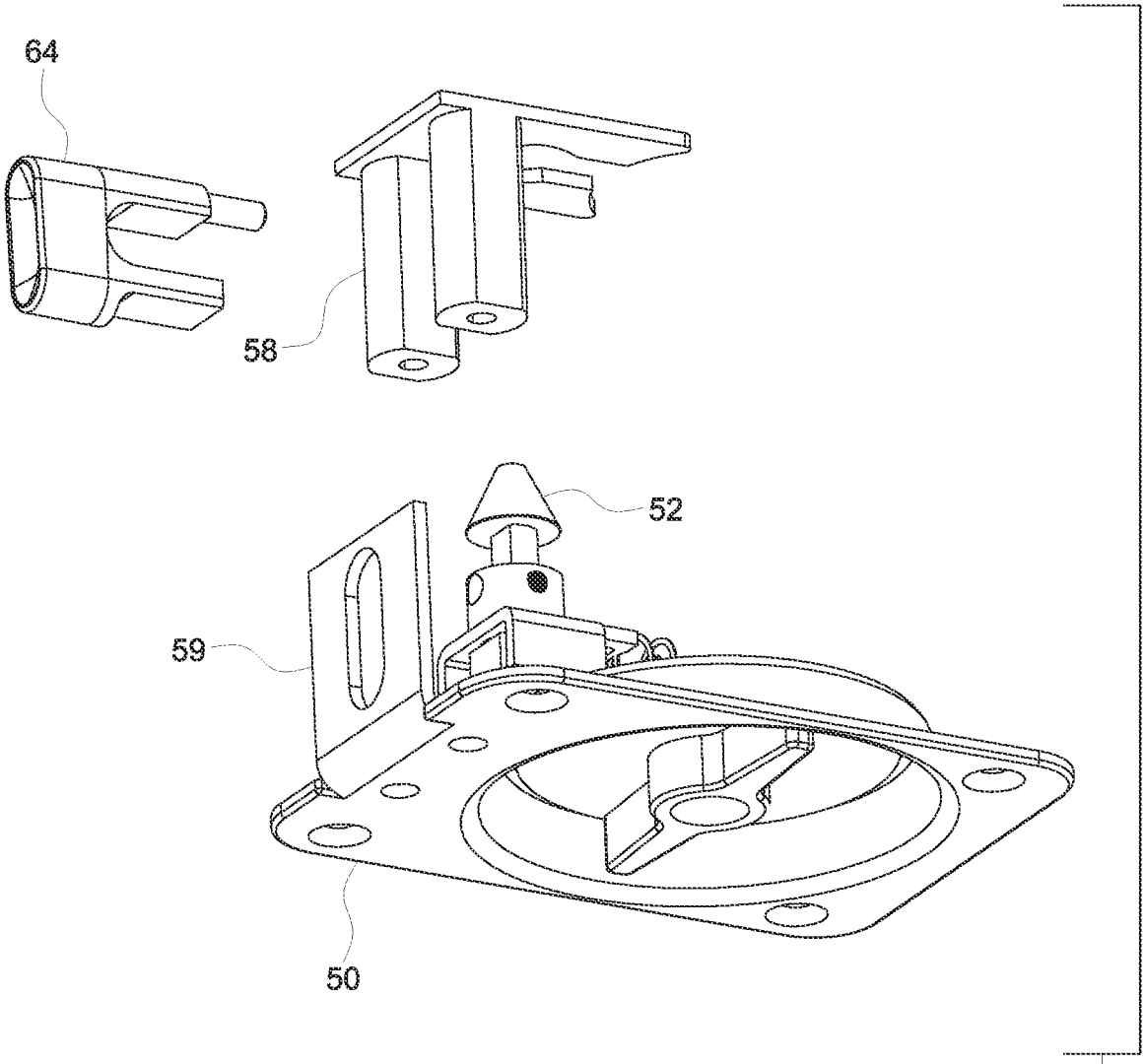
FIG. 12 is a partially exploded bottom perspective view of the latching assembly of FIG. 8.
Figure 13:
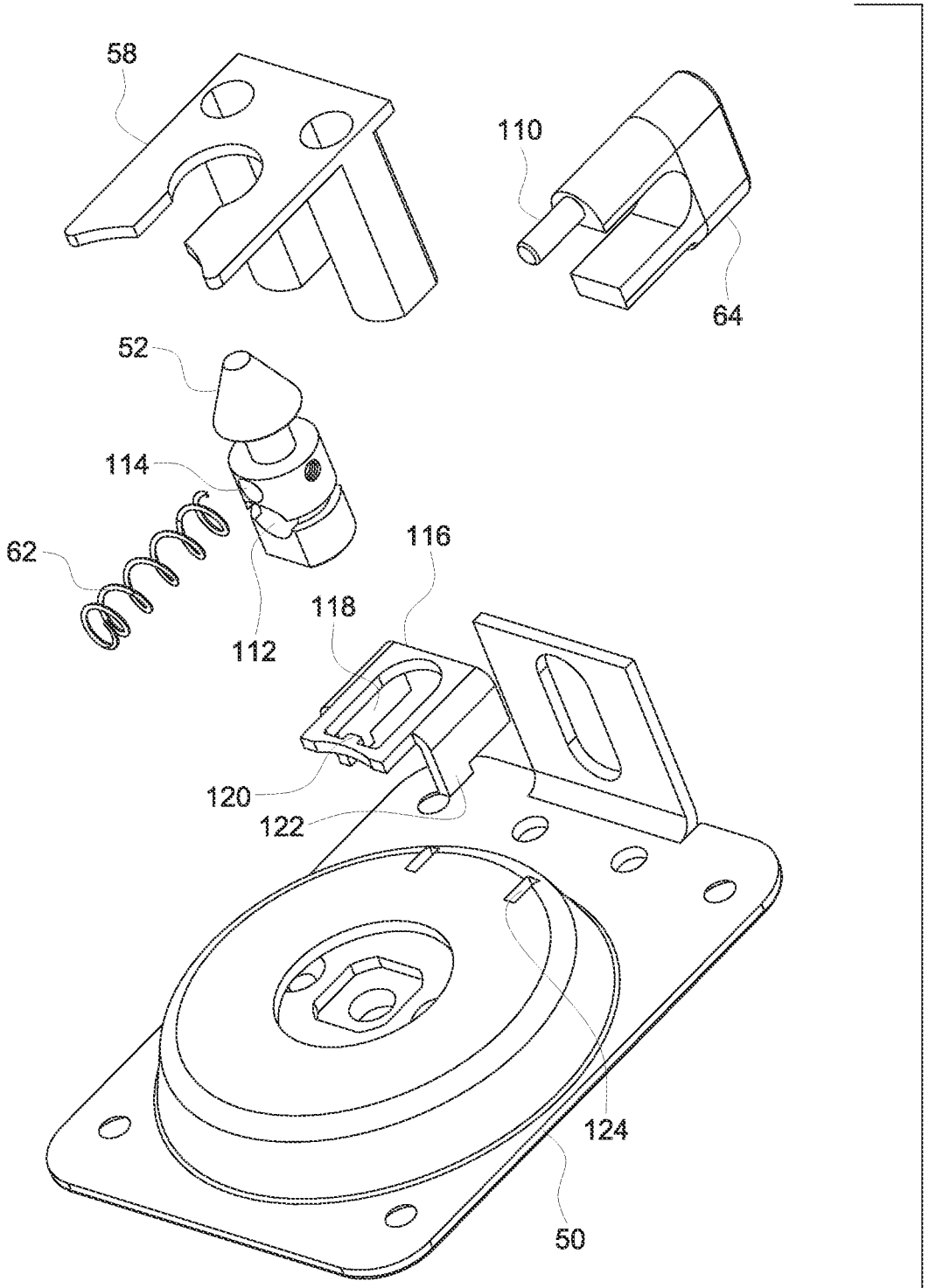
FIG. 13 is a fully exploded top perspective view of the latching assembly of FIG. 8.
Figure 14:
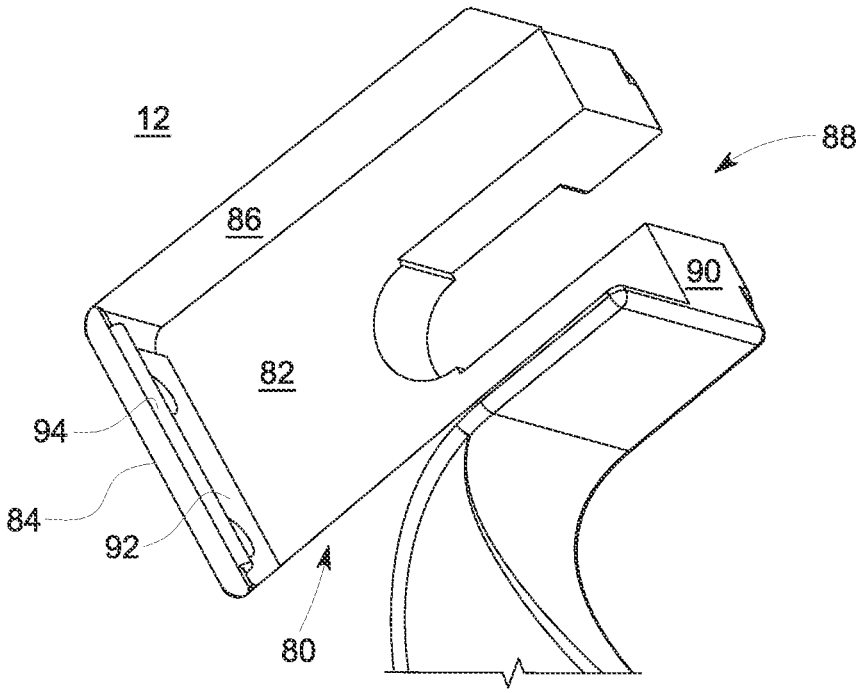
FIG. 14 is a front perspective detailed view of a connection end of the body of the stringed instrument of FIG. 1.
Figure 15:
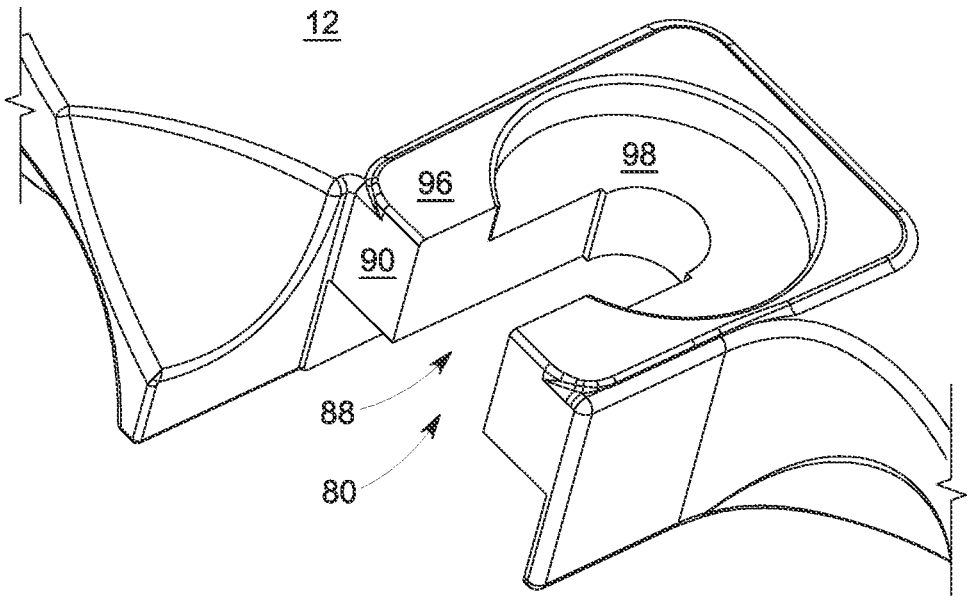
FIG. 15 is a rear perspective detailed view of the connection end of the body of the stringed instrument of FIG. 1.
Figure 16:
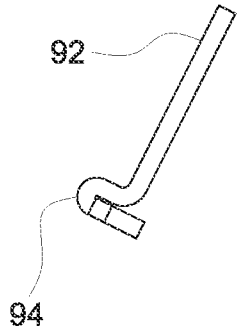
FIG. 16 is a side view of a neck bracket of the stringed instrument of FIG. 1.
Figure 17:
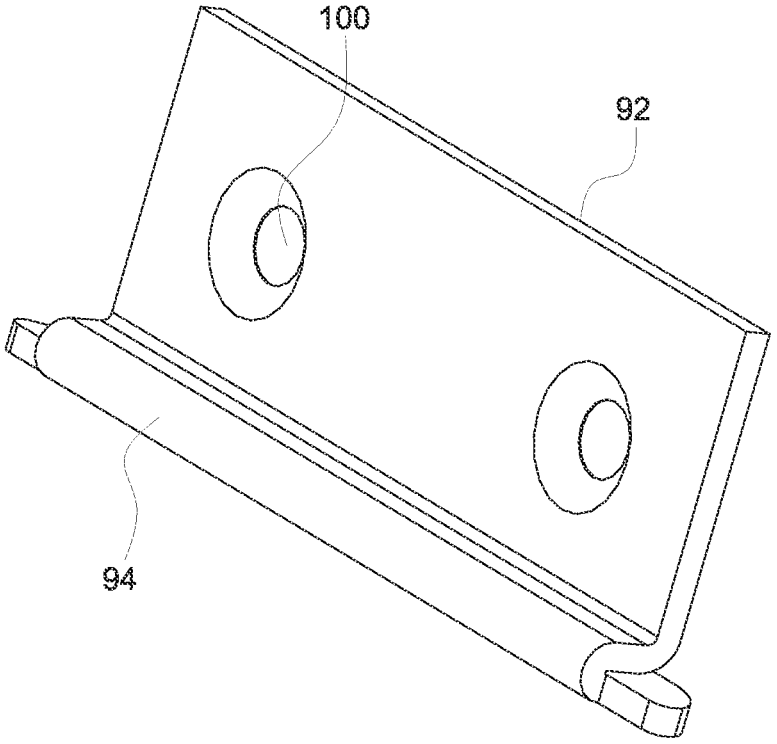
FIG. 17 is a perspective view of the neck bracket of FIG. 16.
Figure 18:
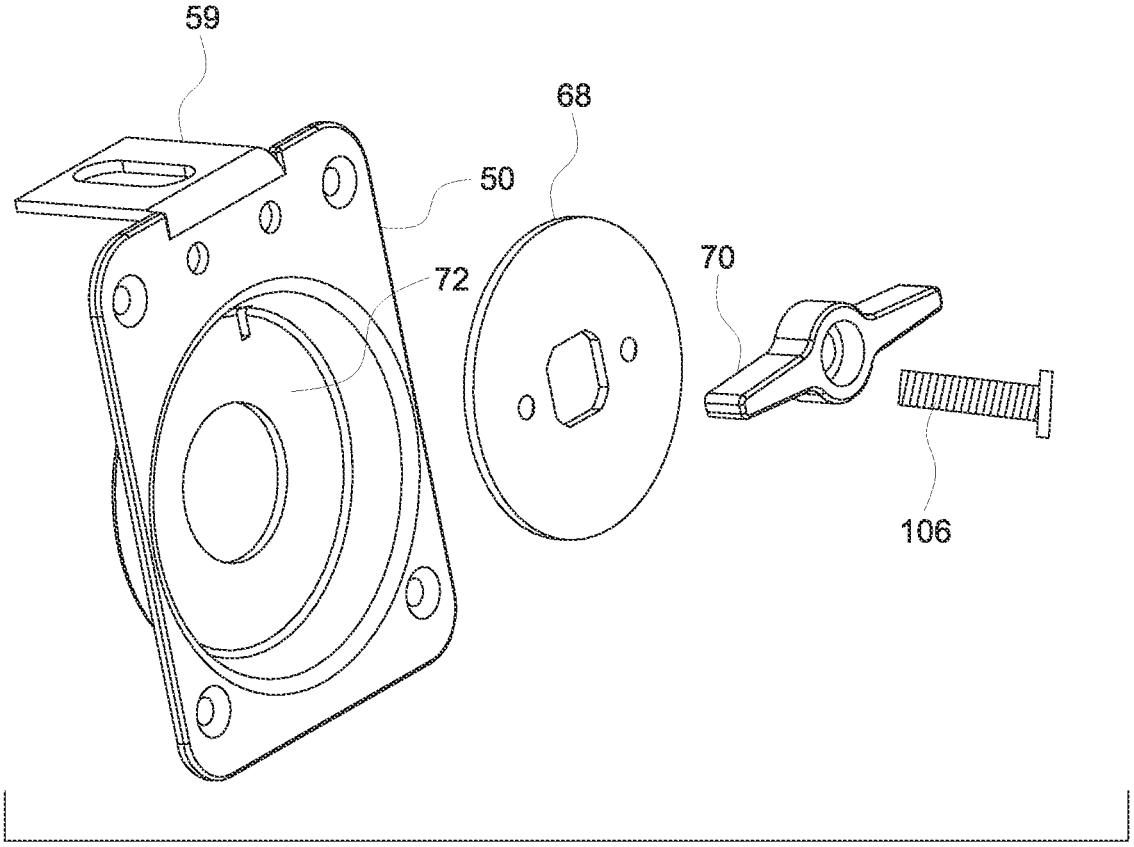
FIG. 18 is an exploded top perspective view of a back plate of the latching assembly of FIG. 8.
Figure 19:
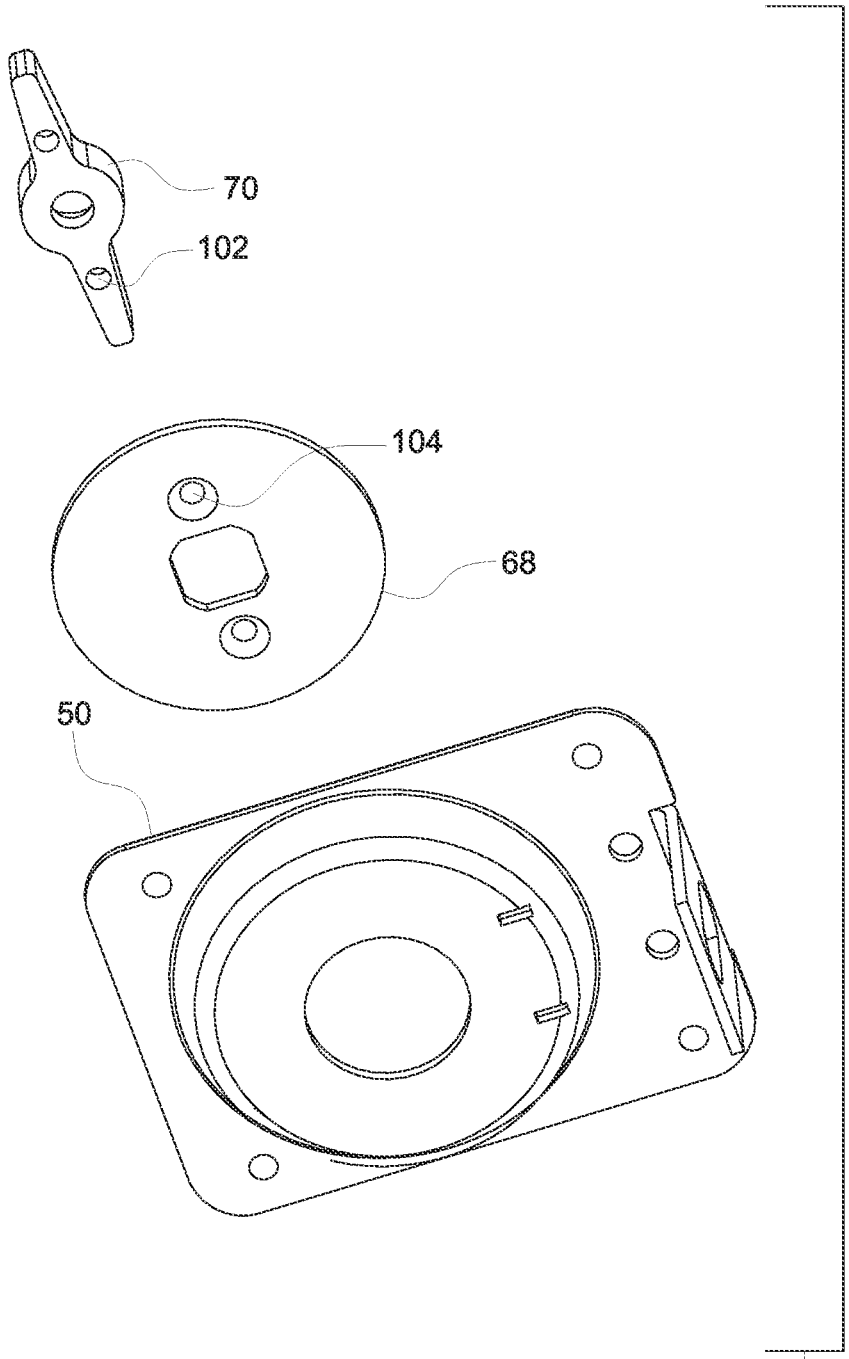
FIG. 19 is an exploded bottom perspective view of the back plate of FIG. 18.

Referring to FIGS. 1 through 18, an attachment mechanism is provided for selective attachment of a stringed instrument neck 14 to a stringed instrument body 12. In some embodiments, the stringed instrument 10 can include a guitar, as shown, or other stringed instruments, including, but not limited to a banjo, a ukulele, or the like. The stringed instrument 10 can include a back plate 50 attachable to a recess 96, 98 in a back side of the stringed instrument body 12. In some embodiments, the back plate 50 can include tapered screw holes 74 for screws (not shown) to attach the back plate 50 to the stringed instrument body 12.

A latching mechanism 20 can be mechanically affixed to the back plate 50. The latching mechanism 20 can include a latch pin retainer 58 that can include a slot 66 formed therein. In some embodiments, screw holes 76 can be formed in the latch pin retainer 58 so that a screw (not shown) can be inserted through the screw holes 76 and thread into threaded holes 78 formed in the back plate 50. Of course, other mechanisms may be used to secure the latch pin retainer 58 to the back plate 50.

A latch pin 52 can extend through the slot 66 of the latch pin retainer 58, where the latch pin 52 can be resiliently urged into a first position, with a lip 56 of the latch pin 52, formed along a latch pin shaft 60 and operable to be secured against a latch pin catch 46 disposed in the stringed instrument neck 14. A sloped side surface 54 of the latch pin 52 can be disposed above the lip 56. The latch pin catch 46 can include a latch pin catch hole 47 for receiving a portion of the lip 56 of the latch pin 52 therein when the stringed instrument neck 14 is locked to and connected with the stringed instrument body 12. The connection surface 40 of the stringed instrument neck 14 can include a hole 44 in which is disposed the latch pin catch 46. A second hole 42 can be formed for receiving a female threaded insert (not shown) for receiving threads of a bolt 106, as discussed in greater detail below. When the stringed instrument body 12 is connected with the stringed instrument neck 14, the connection surface 40 can mate with a base 82 of the recess 80

A button 64 is configured to be operable to move the latch pin 52 into a second position with the lip 56 disengaged from the latch pin catch 46, permitting separation of the stringed instrument neck 14 from the stringed instrument body 12. A back plate extension 59 can be attached to and can extend downward from the back plate 50, where the button 64 is accessible through an opening through the back plate extension 59. In some embodiments, the back plate extension 59 is formed integrally with the back plate 50.

As discussed above, the back plate 50 can fit into the recess 96, 98 in the back side of the stringed instrument body 12. In some embodiments, the back plate 50 can include a concave portion 72 fitting into a first recess 98 in the back side of the stringed instrument body 12. The back plate 50 can further include a flat portion, surrounding the concave portion 72, the flat portion fitting into a second recess 96 in the back side of the stringed instrument body 12. In some embodiments, the second recess 96 can extend to an outer periphery of the stringed instrument body 12. In some embodiments, a through cut 88 can be formed in the end 90 of the stringed instrument body 12, there the through cut 88 can communicate with the first recess 98.

A knob 68 can fit into the concave portion 72, where the knob 68 is configured to turn a bolt 106 operable to fit into threaded portion formed in the hole 42 of the stringed instrument neck 14, as described above. A knob backing plate 68 can attach to the knob 68 in various manners. For example, screw holes 104 may be formed in the knob backing plate 68 so that screws (not shown) can extend therethrough to attach to threaded screw holes 102 in the knob 68.

A back plate 92 can be attached to a back surface 84, between the side walls 86, of a recess 80 formed in a front side of the stringed instrument body 12. The back plate 92 can include a protrusion 94 fitting into a recess 48 formed at an attachment end of the stringed instrument neck 14 when the stringed instrument neck 14 is attached to the stringed instrument body 12. In some embodiments, the recess 80 can extend to an outer periphery of the stringed instrument body 12. In some embodiments, screw holes 100 can be used to secure the back plate 92 to the back surface 84 of the recess 80.

The latching mechanism 20 can include a latch pin bracket 116 having a slot 118 therein through which the latch pin 52 passes. The latch pin bracket 116 can be fixed to an inside surface of the concave portion 72 of the back plate 50. A spring 62 can be positioned in the slot 118 to resiliently urge the latch pin 52 in the first position. A spring receiving hole 112 can be formed partially through a shaft portion 60 of the latch pin 52 for receiving a first end of the spring 62 therein. The second end of the spring 62 may be secured with a spring holding pin 120 formed in slot 118. A button pin 110 can extend from the button 64. The button pin 110 can fit into a button pin hole 114 formed in the latch pin 52.

In some embodiments, the latch pin bracket 116 can include leg extensions 122 that can fit into slots 124 formed in the back plate 50.

In some embodiments, the stringed instrument further includes a headstock 16 removably attached to the stringed instrument neck 14. A ridge 24 can be formed at an attachment end of the headstock 16, where the ridge 24 can retain a nut 22 of the headstock 16 in a space 30 formed between the ridge 24 and a bracket 26. With such a configuration, a user does not have to worry about the nut 22 coming off from multiple times of disassembly of the headstock 16 from the neck 14.

Pins 28 can extend from an attachment end of the headstock 16. The pins 28 can fit into holes formed in the stringed instrument neck 14.

While a particular form of the invention has been illustrated and described, it will be apparent that various modifications can be made without departing from the spirit and scope of the invention. For example, in one embodiment of the invention, the components of the invention can be included as a kit with instructions on how to modify an existing stringed instrument. Alternately, the invention may be integrated into the stringed instrument during manufacturing of the instrument. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An attachment mechanism for selective attachment of a stringed instrument neck to a stringed instrument body, comprising:

a back plate attachable to a back side of the stringed instrument body;

a latching mechanism mechanically affixed to the back plate;

a latch pin retainer of the latching mechanism having a slot formed therein;

a latch pin extending through the slot of the latch pin retainer, the latch pin resiliently urged into a first position, with a lip of the latch pin operable to be secured against a latch pin catch disposed in the stringed instrument neck;

a button operable to move the latch pin into a second position with the lip disengaged from the latch pin catch, permitting separation of the stringed instrument neck from the stringed instrument body; and a back plate extension attached to and extending downward from the back plate, the button accessible through an opening through the back plate extension.

2. The attachment mechanism of claim 1, wherein the back plate fits into a recess in the back side of the stringed instrument body.

3. The attachment mechanism of claim 1, wherein the back plate includes a concave portion fitting into a first recess in the back side of the stringed instrument body.

4. The attachment mechanism of claim 3, wherein the back plate includes a flat portion surrounding the concave portion, the flat portion fitting into a second recess in the back side of the stringed instrument body.

5. The attachment mechanism of claim 4, wherein the second recess extends to an outer periphery of the stringed instrument body.

6. The attachment mechanism of claim 3, further comprising a knob fitting into the concave portion, the knob configured to turn a bolt operable to fit into threaded portion of the stringed instrument neck.

7. The attachment mechanism of claim 1, further comprising a back plate attached to a back surface of a recess formed in a front surface of the stringed instrument body, the back plate having a protrusion fitting into a recess formed at an attachment end of the stringed instrument neck when the stringed instrument neck is attached to the stringed instrument body.

8. The attachment mechanism of claim 7, wherein the recess extends to an outer periphery of the stringed instrument body.

9. The attachment mechanism of claim 1, wherein the back plate includes a concave portion, wherein the latching mechanism includes a latch pin bracket having a slot therein through which the latch pin passes, the latch pin bracket fixed to an inside surface of the concave portion.

10. The attachment mechanism of claim 9, further comprising a spring positioned in the slot to resiliently urge the latch pin in the first position.

11. The attachment mechanism of claim 10, further comprising a spring receiving hole formed partially through a shaft portion of the latch pin for receiving a first end of the spring.

12. The attachment mechanism of claim 1, further comprising a button pin extending from the button, the button pin fitting into a button pin hole formed in the latch pin.

13. A stringed instrument comprising:

a stringed instrument neck;

a stringed instrument body; and an attachment mechanism attaching the stringed instrument neck to the stringed instrument body, the attachment mechanism comprising:

a back plate attachable to a back side of the stringed instrument body;

a latching mechanism mechanically affixed to the back plate;

a latch pin retainer of the latching mechanism having a slot formed therein;

a latch pin extending through the slot of the latch pin retainer, the latch pin resiliently urged into a first position, with a lip of the latch pin operable to be secured against a latch pin catch disposed in the stringed instrument neck;

a button operable to move the latch pin into a second position with the lip disengaged from the latch pin catch, permitting separation of the stringed instrument neck from the stringed instrument body; and a back plate extension attached to and extending downward from the back plate, the button accessible through an opening through the back plate extension.

14. The stringed instrument of claim 13, further comprising a headstock removably attached to the stringed instrument neck.

15. The stringed instrument of claim 14, further comprising a ridge formed at an attachment end of the headstock, the ridge retaining a nut of the headstock.

16. The stringed instrument of claim 14, further comprising pins extending from an attachment end of the headstock, the pins fitting into the stringed instrument neck.

17. The stringed instrument of claim 13, wherein the back plate includes a concave portion fitting into a first recess in the back side of the stringed instrument body.

18. The stringed instrument of claim 17, wherein the back plate includes a flat portion surrounding the concave portion, the flat portion fitting into a second recess in the back side of the stringed instrument body.

19. The stringed instrument of claim 17, wherein the attachment mechanism further comprises a knob fitting into the concave portion, the knob configured to turn a bolt operable to fit into threaded portion of the stringed instrument neck.

* * * * *